US005564501A

United States Patent [19]

Strattan et al.

[11] Patent Number: 5,564,501

[45] Date of Patent: Oct. 15, 1996

[54] CONTROL SYSTEM WITH COLLECTION CHAMBER

[75] Inventors: Scott C. Strattan; Grant R. Thompson, both of Tulsa, Okla.

[73] Assignee: Baker Hughes Incorporated, Houston, Tex.

[21] Appl. No.: 440,719

[22] Filed: May 15, 1995

[51] Int. Cl.[6] ..... E21B 34/10

[52] U.S. Cl. ..... 166/375; 166/321; 166/324; 166/386

[58] Field of Search ..... 166/375, 386, 166/321, 324, 72

[56] References Cited

U.S. PATENT DOCUMENTS

| | | | |
|---|---|---|---|
| 4,119,146 | 10/1978 | Taylor | 166/72 |
| 4,135,547 | 1/1979 | Akkerman et al. | 137/315 |
| 4,149,698 | 4/1979 | Deaton | 166/324 X |
| 4,173,256 | 11/1979 | Kilgore | 166/324 |
| 4,234,043 | 11/1980 | Roberts | 166/319 X |
| 4,252,197 | 2/1981 | Pringle | 166/322 |
| 4,325,409 | 4/1982 | Roberts | 137/596.14 |
| 4,373,587 | 2/1983 | Pringle | 166/324 |
| 4,431,051 | 2/1984 | Adams, Jr. | 166/72 |
| 4,467,867 | 8/1984 | Baker | 166/188 |
| 4,569,398 | 2/1986 | Pringle | 166/321 |
| 4,636,934 | 1/1987 | Schwendemann | 364/132 |
| 4,660,646 | 4/1987 | Blizzard | 166/321 |
| 5,251,702 | 10/1993 | Vazquez | 166/324 |
| 5,415,237 | 5/1995 | Strattan | 166/375 |

FOREIGN PATENT DOCUMENTS

| | | |
|---|---|---|
| 1577828 | 10/1980 | United Kingdom . |
| 2163793 | 3/1986 | United Kingdom . |

OTHER PUBLICATIONS

"TRC Services Pressure Charges Safety Valves", Cameo 1992–1993 Catalog excerpt, pp. 48–49.

*Primary Examiner*—Hoang C. Dang
*Attorney, Agent, or Firm*—Rosenblatt & Redano, P.C.

[57] ABSTRACT

The invention relates to a control system for a subsurface safety valve (SSV). A pressure-balance feature is introduced such that the control system components are unaffected by the depth of placement of the SSV. Through the use of this feature, the standard hydraulic control system used for surface components can also be used for an SSV regardless of its depth of installation. In another feature of the invention, a shuttle valve is provided so that each time the SSV is stroked, a volume of control fluid is purged into the annulus. One embodiment of the shuttle valve may or may not be sensitive to annulus pressure and employs annulus pressure as an aid to stroking the shuttle valve upon application of surface control pressure to assist in actuation of the SSV, while at the same time providing for a purge of a controlled volume of fluid.

34 Claims, 12 Drawing Sheets

CONTROL SYSTEM WITH COLLECTION CHAMBER

FIELD OF THE INVENTION

The field of the invention relates to control systems, particularly those used for hydraulically controlling subsurface safety valves.

BACKGROUND OF THE INVENTION

In the past, subsurface safety valves ("SSV's") have been controlled from hydraulic control systems from the surface. Hydraulic control systems are commonly used on production rigs for control of surface safety components. The SSV is located at or adjacent the base of the wellbore, or in a location immediately above the producing zone at the time. In emergency situations, a rapid shutdown of the SSV is required. The SSV's of prior designs have been actuated by movable sleeves, which have in turn been actuated by a hydraulic system from the surface. In applications involving great depths, the auxiliary tubing, run adjacent the production string for control of the SSV, develops considerable hydrostatic head pressures at the control mechanism downhole adjacent the SSV. To compensate for the developed static head pressures from the control fluid column in the control tubing, springs or other compensating devices have been used to counteract such forces. In these designs, the SSV remains closed until additional pressure is developed in the control tubing from the surface to overcome the spring force, thereby directing the control tubing pressure to shift the sleeve in order to open the valve. These systems were set to be failsafe because upon withdrawal or loss of the control system pressure, the spring acting on the piston would result in movement of the piston, with the final resulting action being the shifting of the sleeve, allowing the SSV to close.

Typical of such designs is U.S. Pat. No. 4,173,256. In that design, a spring biases a piston against the hydrostatic head in the tubing control line from the surface. Once the pressure is raised beyond the resistance of the spring and hydrostatic pressure from the annulus, the piston is displaced, compressing the spring and control pressure is communicated to the sliding sleeve to open the SSV. The SSV sleeve is spring-biased against production tubing pressure so that it retracts upon removal of control pressure, allowing the SSV to slam shut. Once the control pressure is removed, the spring in the control system pilot valve pushes the piston to close off the control fluid supply line and to vent the accumulated fluid adjacent the shifting sleeve behind the pilot valve piston into an area in fluid communication with the annulus.

One of the problems of the prior designs, particularly for applications involving significant well depths, was that high operating pressures were required for the control system in order to initiate movement of the sliding sleeve in the production tubing, as well as the pilot valve piston in the control system, for actuating of the SSV. The pilot piston spring had to resist higher hydrostatic heads in the control line due to the greater depth. Typically in these deep-well applications, the hydraulic control system used for other surface emergency components, would be of an insufficient pressure rating for the pressures typically required in a control system for an SSV which may be mounted 8,000–15,000 ft below the surface. Accordingly, operators would have to use discrete hydraulic control systems rated for the desired operating pressures for the sole purpose of actuation of the SSV. This involved additional expense to the rig operator. It also created space problems on the rig where space for operational components is at a premium. The hydraulic control systems used for surface components generally operated in the pressure range of between 1,000–3,000 psi. The pressure requirements for the SSV at deep installations could be as high as 10,000–15,000 psi. The higher pressure system required pipe and fittings rated for the higher pressure service and precluded the use of the standard hydraulic control systems normally present in a rig.

The apparatus and method of the present invention presents a configuration where the hydrostatic forces from applications at large depths have become inconsequential due to a balanced design for the actuation system. The actuation system is exposed to production tubing pressure on opposing surface areas of approximately equal area, thus putting the actuation mechanism in a force balance until the balance is upset by application of control pressure from the surface, triggering movement of the SSV. In another feature of the invention, the need for occasional purging of control fluid from the control system of an SSV is accomplished. Purging is particularly beneficial because uses of water-based control line fluids have increased sensitivities to contamination and breakdown. Traditional systems for control of SSV's from the surface involve systems that have a fixed volume, as opposed to one where the control fluid is circulated. A circulating system would require a pair of control lines down to the SSV and would increase complications in installation and operation. Without the ability to do purging or circulation, the control fluid could prematurely fail and damage control system components such as seals. In another feature of the apparatus and method of the present invention, a shuttle valve has been designed which facilitates the operation of the control system and, for each cycle of opening and closing the SSV, purges a fixed amount of control fluid from the system so that premature failure of system components such as seals does not occur.

SUMMARY OF THE INVENTION

The invention relates to a control system for an SSV. A pressure-balance feature is introduced such that the control system components are unaffected by the depth of placement of the SSV. Through the use of this feature, the standard hydraulic control system used for surface components can also be used for an SSV regardless of its depth of installation. In another feature of the invention, a shuttle valve is provided so that each time the SSV is stroked, a volume of control fluid is purged into the annulus. One embodiment of the shuttle valve may or may not be sensitive to annulus pressure and employs annulus pressure as an aid to stroking the shuttle valve upon application of surface control pressure to assist in actuation of the SSV, while at the same time providing for a purge of a controlled volume of fluid.

DETAILED DESCRIPTION OF THE PREFERRED EMBODIMENT

One feature of the apparatus A of the present invention is shown in FIGS. 1A–C and 10A–C. FIGS. 1A–C and 10A–C are actually two different positions of the apparatus A of the present invention, as can be seen by comparing FIGS. 1C and 10C. The SSV B is in the open position (FIG. 1C), with sleeve 10 shifted downwardly until it contacts shoulder 12 to maintain the SSV B open in a manner known in the art. Similarly, the retraction of sleeve 10 to the position shown in the other view of FIG. 10C allows the SSV B to close via the urging of spring 14.

Figure 2A:
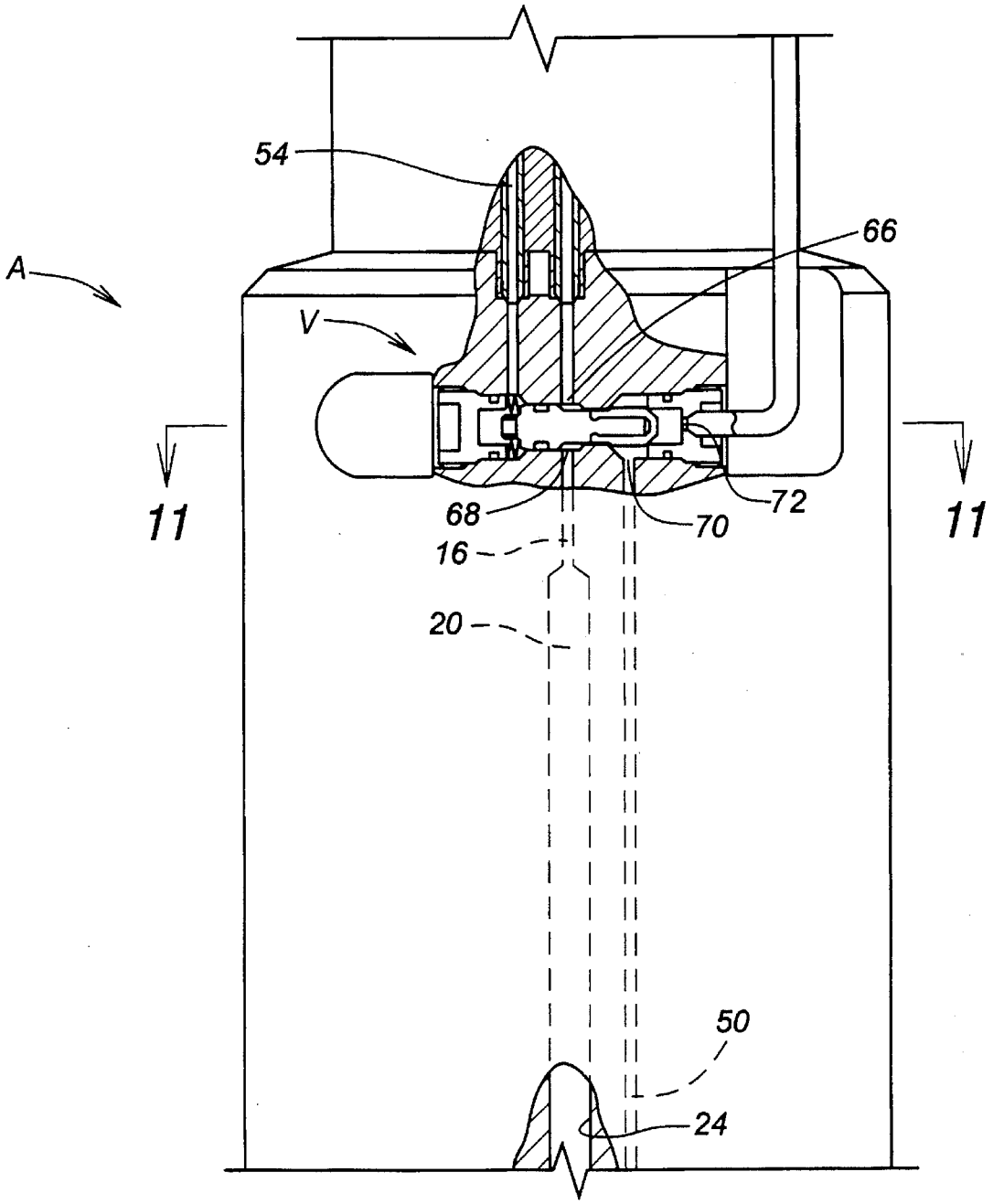
FIG. 2A–D is a detailed view showing the control lines and their routing in the embodiment shown in FIG. 1A–C.
Figure 2B:
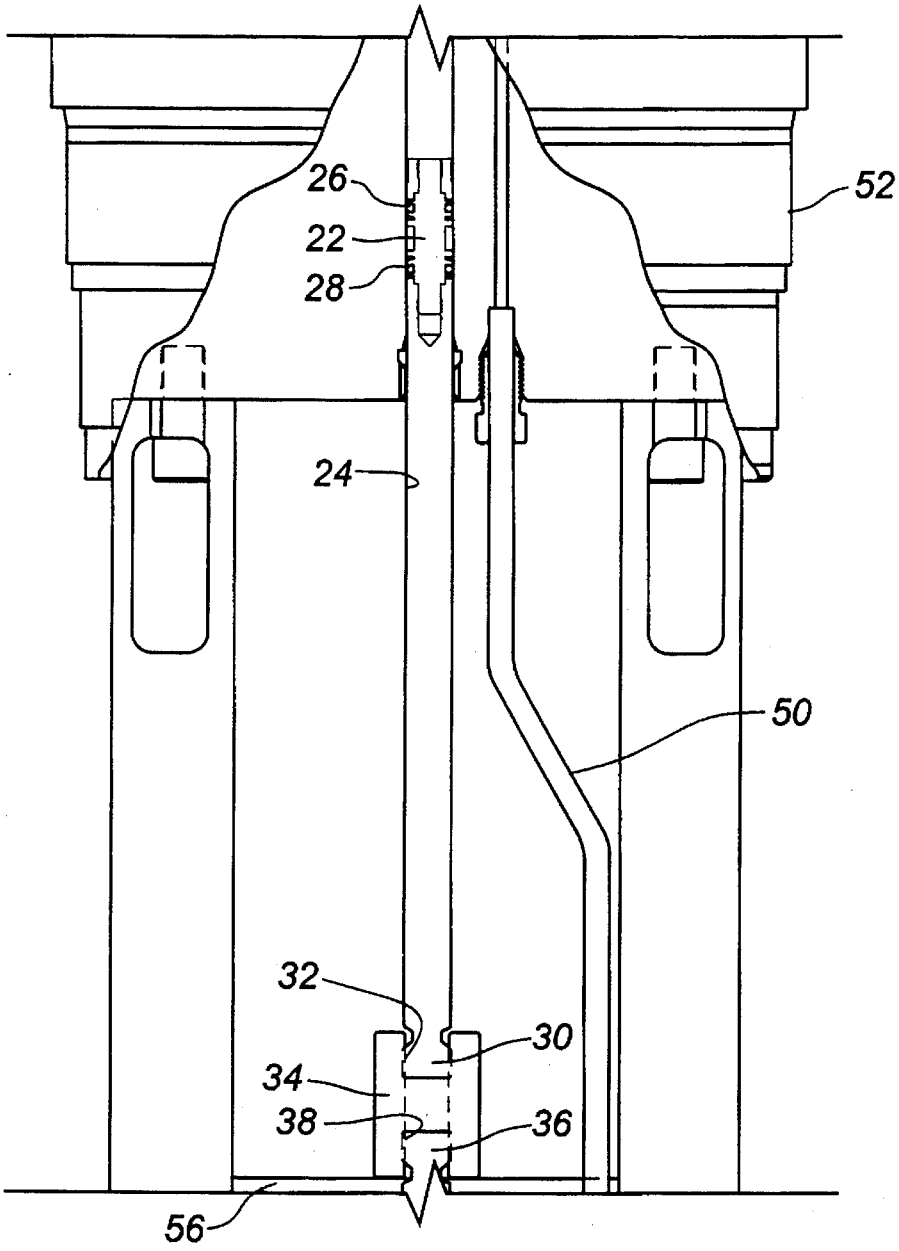
Figure 2C:
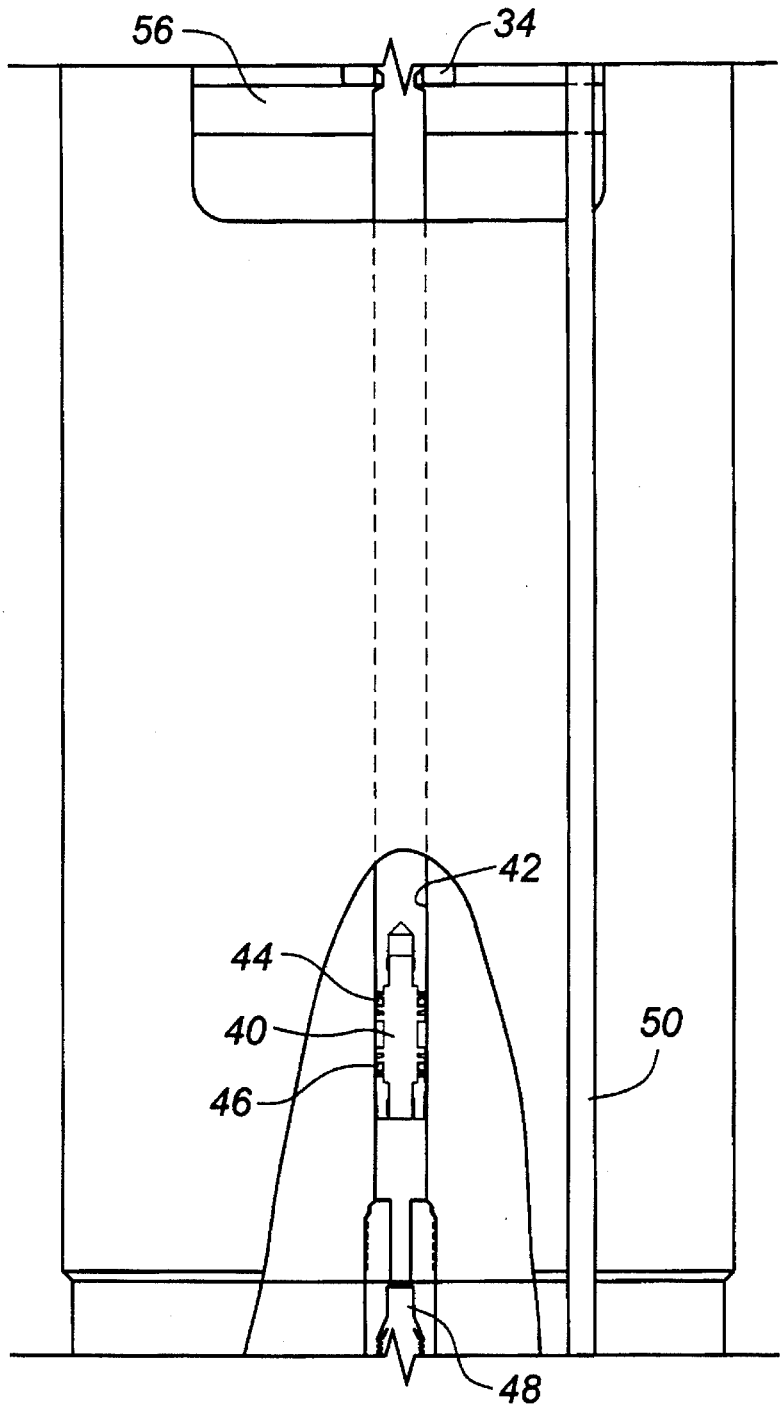
Figure 2D:
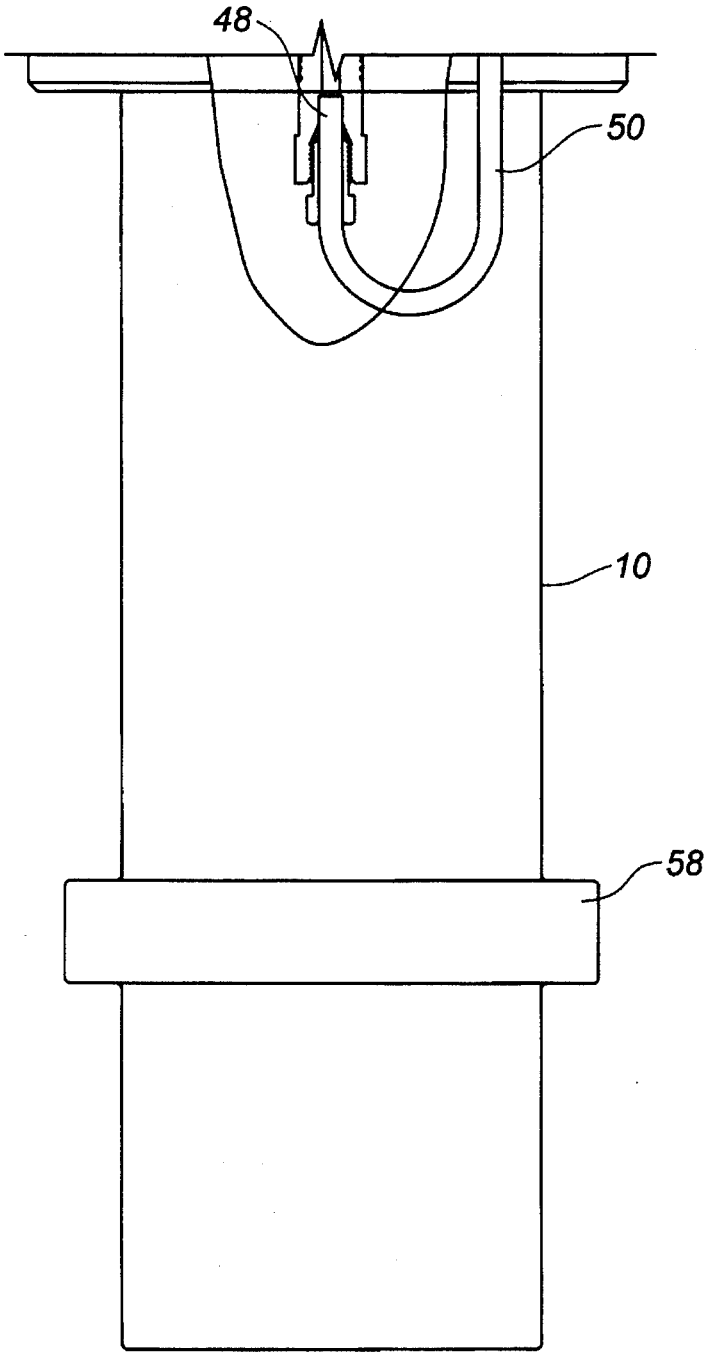

Control line pressure is applied to the apparatus A through port 16. Traditionally this is done by auxiliary tubing (not shown) run from the surface outside the production tubing (not shown), which is typically connected at thread 18. Port 16 communicates with cavity 20. Piston 22 is disposed in bore 24, with seals 26 and 28 sealing therebetween. A lug 30 is formed at the lower end of piston 22. Lug 30 conforms to a cutout 32 on connector 34. Connector 34 has another cutout 36 which accommodates lug 38 on piston 40. Piston 40 rides in bore 42 and is sealed off against bore 42 by seals 44 and 46. As seen in FIGS. 2C and D, bore 42 is in fluid communication with conduit 48, with conduit 48 leading to control line 50. Control line 50 leads into housing 52. Ultimately, line 50 and connection 54 are tied into the shuttle valve V of the present invention, schematically illustrated in FIGS. 3 and 4.

Connector 34 is in contact with tab 56 on sleeve 10. Sleeve 10 also has a tab 58 with spring 60 bearing on it. Spring 60 supports the weight of sleeve 10 and is compressed by tab 58 when the SSV B is in the open position.

As previously stated, the production tubing (not shown) is connected at threads 18. The flowpath 62 extends through the production tubing from the surface down to the SSV B. Connector 34 is exposed to the pressure in the production tubing flowpath 62. The symmetrical construction of connector 34, as well as pistons 22 and 40, puts connector 34, as well as pistons 22 and 40, in pressure balance with respect to the applied pressure in the flowpath 62. As will be described below, an increase in pressure in port 16 shifts the assembly of pistons 22 and 40 downwardly, which in turn moves connector 34 in the same direction. Connector 34 bearing down on tab 56 shifts sleeve 10 downwardly to open the SSV B. In order to close the SSV, pressure conditions are created such that the pressure in chamber 20 is less than conduit 48 which, by virtue of relaxation of spring 60, shifts sleeve 10 upwardly so that the SSV which had previously been held open can spring shut through the operation of spring 14. The apparatus A of the present invention as previously described is different than prior systems which employed a single piston cylinder combination, with one side of the piston exposed to pressure in flowpath 62 and the other side exposed to control system pressure at a port such as 16. In those prior systems, a spring such as spring 60 was required to resist the hydrostatic pressure created in the control tubing from the surface down to a port such as 16. For applications involving significant depths, the spring rate that had to be used on such springs as 60 was significant in order to support a piston against the hydrostatic load in the control tubing. Additionally, sleeves in prior designs had to overcome production tubing pressure to be shifted down to open the SSV. The control line hydrostatic would partially offset the required opening force. As a result, in order to shift the sleeve in prior designs, significant hydraulic pressures had to be applied to the piston to overcome the resistance of the stiff spring rate of a spring required to resist the hydrostatic forces in an effort to open the SSV. This is to be contrasted with the present design where the actuation assembly involving pistons 22 and 40 are in pressure balance with respect to the production flowpath 62. As a result, spring 60 need only support the weight of sleeve 10 and, therefore, can be a spring with a significantly lower spring rate than those that would have in the past been required to service deep applications. For example, in the past a spring such as 60 on a prior design, without the pressure-balance feature of the present invention, would have required spring forces in the order of 700 lbs. when the SSV B is in the closed position, whereas use of the apparatus of the present invention, in a comparably sized valve at the same depth, can now employ a spring having a preload force of about 50 lbs. or less when the SSV B is closed. The natural outcome of the use of springs with smaller spring rates is that the actuation pressure that is applied at port 16 to initiate opening of the SSV B is reduced from prior applications where pressures in the order of 10,000–15,000 psi were required. Now, with the apparatus of the present invention, pressures on the control system at the surface can be down to a range of 1,000–3,000 psi. This allows the use of existing hydraulic control system components for surface equipment to also be used for controlling of the SSV.

Figure 1A:
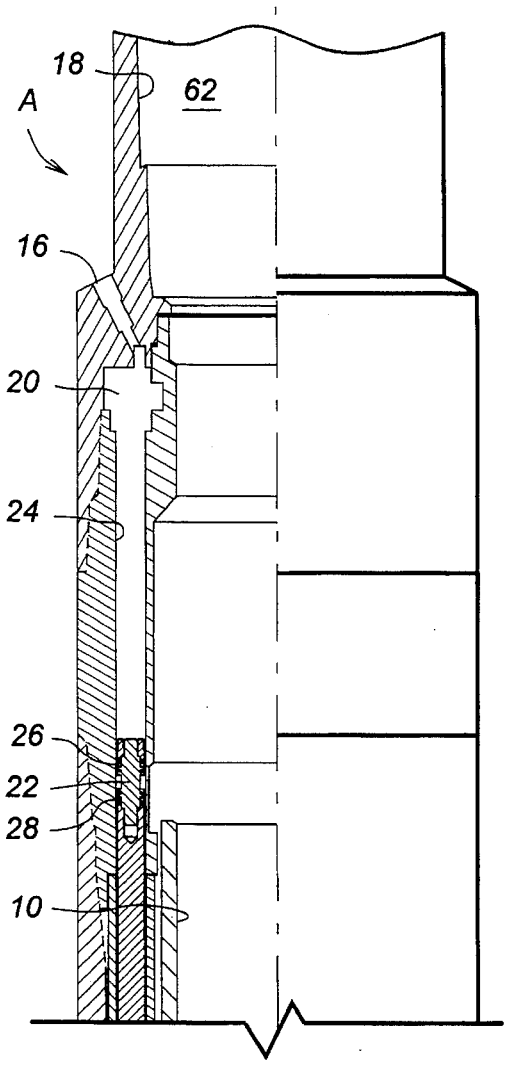
FIG. 1A–C is a sectional elevational view of one of the features of the present invention, illustrating the pressure-balance actuating system, showing the SSV in the open position.
Figure 10A:
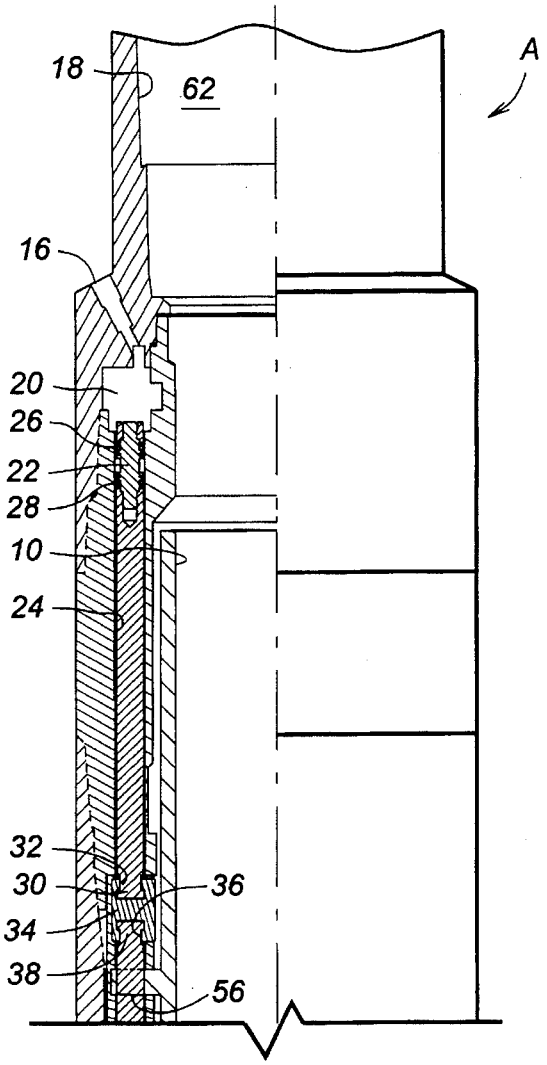
FIG. 10A–C is a sectional elevational view of one of the features of the present invention, illustrating the pressure-balance actuating system, showing the SSV in the closed position.
Figure 3:
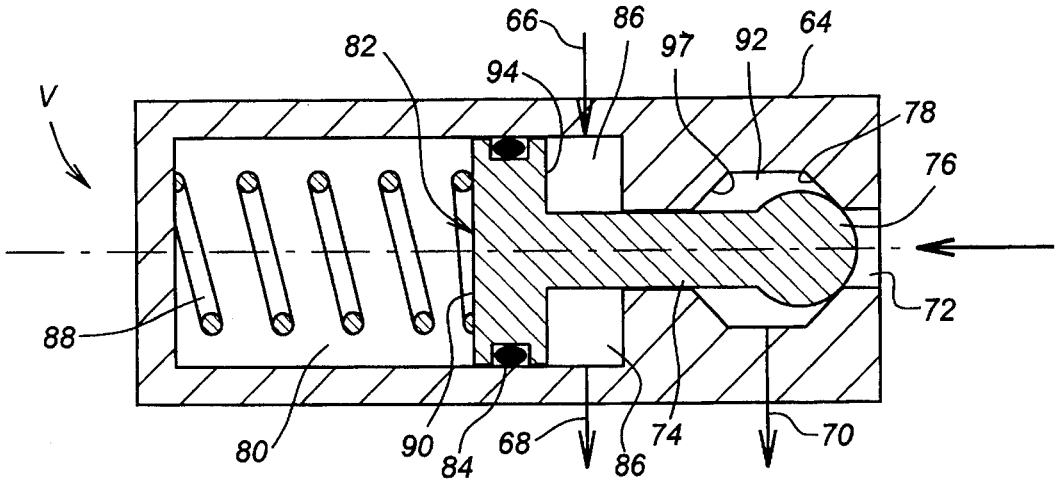
FIG. 3 is a schematic representation of the shuttle valve of the present invention.
Figure 4:
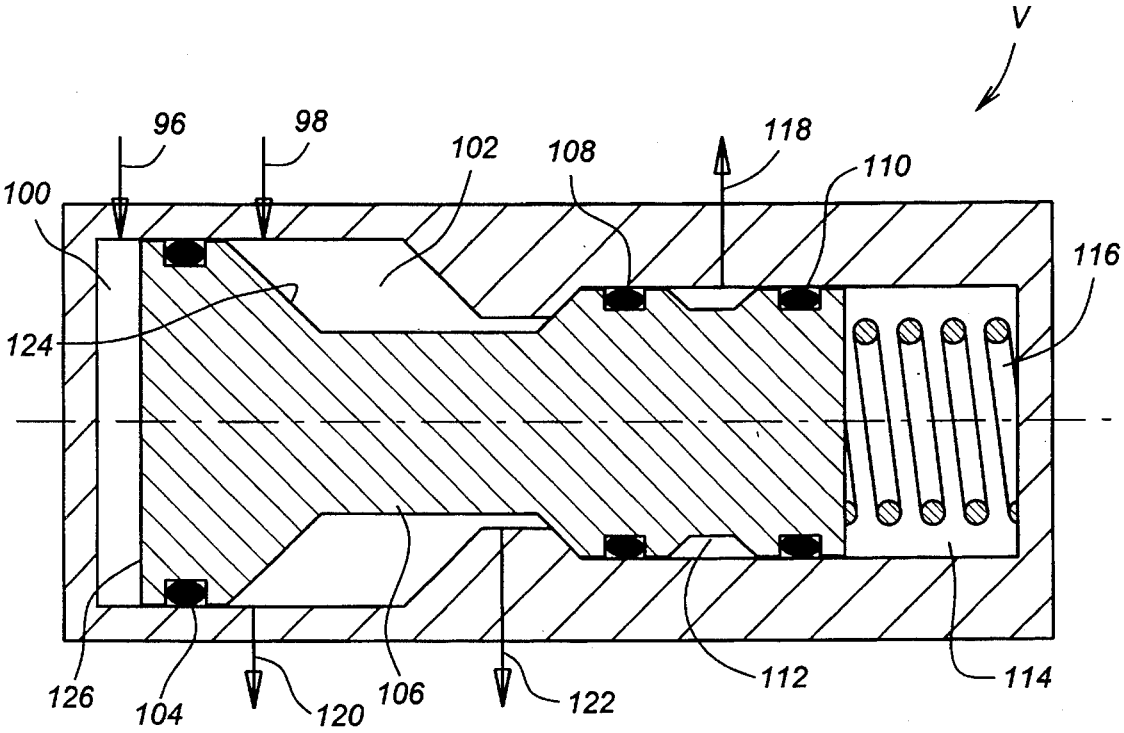
FIG. 4 is an alternative design for the shuttle valve shown in FIG. 3.

Referring now to FIGS. 3 and 4, the shuttle valve V of the present invention will be described. Shuttle valve V has a housing 64 which contains a plurality of ports. The first port is represented by arrow 66. Arrow 66 indicates the connection point of the control line which is run from the surface to shuttle valve V. Shuttle valve V has a pair of output connections 68 and 70. Output connection 68, as indicated schematically by the arrow, is ultimately connected to port 16, as illustrated in FIGS. 1A and 10A. Output port 70 in FIG. 3 is schematically illustrated by virtue of the arrow to be ultimately connected to control line 50 through housing 52 (see FIG. 2). Shuttle valve V has an opening 72 which is in flow communication with the annulus outside the production tubing (not shown). Inside shuttle valve V is a piston 74. In the preferred embodiment piston 74 has one end 76 shaped essentially spherically for sealable contact against seat 78. The other end of piston 74 extends into chamber 80. End 82 on piston 74 has a cylindrical component conforming to the shape of cavity or chamber 80. Seal 84 is imbedded in a groove in end 82 effectively dividing chamber 80 into two chambers, 80 and 86. Also found in chamber 80 is a compensating spring 88 which bears on surface 90 of piston 74. Chamber 80 can be initially at atmospheric pressure or can have pressures higher than atmospheric. The higher the trapped pressure in chamber 80, the weaker the compensating spring that will need to be used for a predetermined range of expected annulus pressures.

In operation, port 72 is normally closed due to the contact of spherical end 76 with seat 78. This seating engagement is further encouraged by any pressure in chamber 86, as well as spring force applied from spring 88. The SSV B is designed to failsafe in the closed position. In order to initiate the steps to open the SSV by sliding sleeve 10 (see FIG. 1), hydraulic pressure is applied from the surface into port 66, represented by the arrow. Port 66 is in communication with chamber 86 as well as chamber 92, in the position shown in FIG. 3. This is because no seal exists between the housing 64 and piston 74 in the area between chambers 86 and 92. Since the same pressure initially applied to port 66 exits the valve V through ports 68 and 70, there is no differential pressure applied to the assembly of pistons 22 and 40 (see FIG. 1), and hence no movement of sleeve 10. However, as pressure is allowed to build up from the surface into port 66, an unbalanced force acting on piston 74 is generated. This occurs when the pressure in cavity 86 applied on annular surface 94, as well as annulus pressure applied through port 72 onto end 76, exceeds the force in the opposite direction applied by spring 88 to surface 90, as well as the pressure in chamber 80 also applied to surface 90. At that point, piston 74 begins to move in a direction where chamber 80 becomes smaller and chamber 86 becomes larger. As a result of such movement, end 76 moves away from seat 78. Port 70, represented by the arrow which, in effect, leads to conduit 48 (see FIG. 2), is now placed in alignment with open port 72, which communicates with the annulus. Accordingly, built-up pressure formerly in cavity 92, which had been applied to piston 40 through conduit 48, is now relieved to the annulus. The built-up pressure in chamber 86, which is now sealed from chamber 92 at seat 97, acts on piston 22 through ports 68 and 16. The pressure imbalance between pistons 22 and 40 causes sleeve 10 to move downward by contact between connector 34 and tab 56, compressing spring 60 and opening the SSV B.

When it is desired to close the SSV B, the pressure applied to port 66 from the surface is removed. Eventually, a force imbalance in the opposite direction occurs on piston 74 and it moves in the direction toward port 72 until end 76 once again reseats against seat 78. The removal of pressure from the surface coming to inlet 66 also reduces the pressure exiting valve V through port 68, which ultimately gets into port 16, as shown in FIG. 1A. The reduction of control pressure in port 16 allows spring 60 to shift sleeve 10 and finally to allow spring 14 to close the SSV B.

Shown in FIG. 4 is an alternative embodiment of the shuttle valve V of the present invention. In the schematic representation shown in FIG. 4, pressure in the control line is applied from the surface to ports 96 and 98, as represented schematically by the arrow shown. Port 96 is in fluid communication with chamber 100. Chamber 100 is isolated from chamber 102 by seal 104 encircling piston 106. Piston 106 further has a pair of seals 108 and 110 which straddle groove 112. Shuttle valve V further has a chamber 114 within which resides a spring 116. Chamber 114 is scaled by virtue of seal 110 and contains a compressible fluid which can be at atmospheric pressure or at some higher pressure. The spring rate required for spring 116 varies inversely with the amount of pressure trapped in chamber 114. Groove 112 is in flow communication with outlet 118, represented schematically by an arrow. Outlet 118 is in fluid communication with the annulus outside the production tubing. Chamber 102 has a pair of exit ports 120 and 122, both shown schematically by arrows. Port 120 is connected to what is shown as port 16 in FIG. 1, while port 122 is in fluid communication ultimately with line 50 through housing 52, as shown in FIG. 2.

In operation, the sequence to open the SSV B requires a build-up of control pressure from the surface into ports 96 and 98. When pressure has been built up in ports 96 and 98 to a predetermined amount, a force imbalance occurs on piston 106, which operates against the spring 116 and the compressible fluid in chamber 114. The supply pressure in the control line introduced into chamber 102 from port 98 exits the valve V and acts on pistons 22 and 40 through outlets 120 and 122, respectively. Since initially the pressure exiting valve V from outlets 120 and 122 is the same, no movement of sleeve 10 occurs. However, once the force imbalance situation is achieved on piston 106, it begins to shift to the right, making cavity 114 smaller while enlarging cavity 100. While the same pressure is always applied to inlets 96 and 98, the exposure surface to the piston 106 in chamber 102 is tapered surface 124, which has a smaller cross-sectional area than circular surface 126 on the top of piston 106. Ultimately, the pressure in chamber 100 acting on surface 126 overcomes the combined resistance to movement of piston 106 offered by the pressure in chamber 102 acting on surface 124 in combination with the spring 116 and the compressible fluid in chamber 114. As piston 106 moves to make chamber 114 smaller, seal 108 and groove 112 pass beyond opening 118. This places opening 118, which is in flow communication to the annulus, in flow communication with outlet 122, which is in flow communication with line 50 and conduit 48 going to piston 40. At the same time, seal 104 passes outlet 120. Accordingly, the pressure applied from the control line at the surface passes through chamber 100 into outlet 120 to act through opening 16 onto piston 22. The combination of a build-up of pressure on top of piston 22, together with the relief of pressure in line 50 and conduit 48, puts an unbalanced force on connector 34. In turn, connector 34 bears down on tab 56, pushing sleeve 10 down against the resistance of spring 60 to open the SSV B. As long as a sufficient force is applied in the control line from the surface to prevent return movement of piston 106, the SSV B stays open. At the same time that the task of opening the SSV B has been accomplished, a controlled volume from the control system, primarily from line 50 and conduit 48, is purged from the system into the annulus. This occurs because the annulus is at a lower pressure than line 50 and conduit 48 at the time that groove 112 and seal 108 pass beyond outlet 118. When it is desired to close the SSV B, pressure is removed from the control line from the surface, reducing the applied pressure at ports 96 and 98. A pressure imbalance on piston 106 in the direction of making chamber 100 smaller now occurs. As soon as piston 106 shifts sufficiently so that seal 104 again passes outlet 120 to the position shown in FIG. 4, the built-up pressure in outlet 120, which as previously stated is connected to port 16 and ultimately to piston 22, is now equalized with port 122. This facilitates spring 60 pushing on tab 58 to shift sleeve 10 upwardly through its connection to connector 34 and tab 56. As a result, the SSV B closes.

Figure 7:
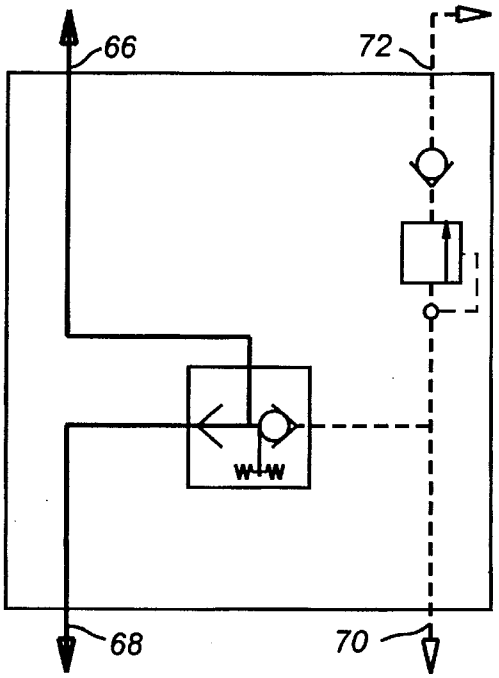
FIG. 7 is the control diagram of FIG. 6 with sufficient surface pressure applied to actuate the SSV.
Figure 6:
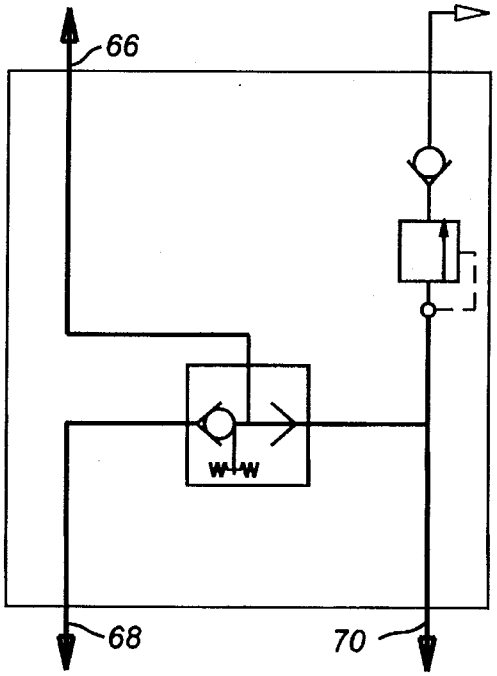
FIG. 6 is the control system of FIG. 5, with applied control pressure from the surface prior to any venting to the annulus.
Figure 5:
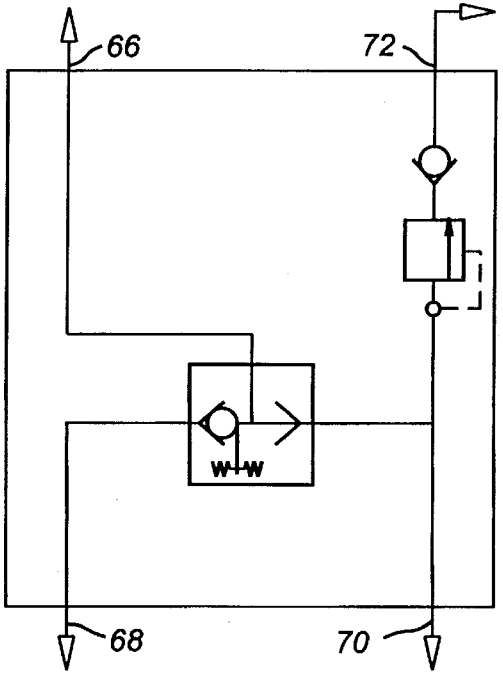
FIG. 5 is a hydraulic diagram of the operation of the shuttle valve and control system, of which it is a part.
Figure 9:
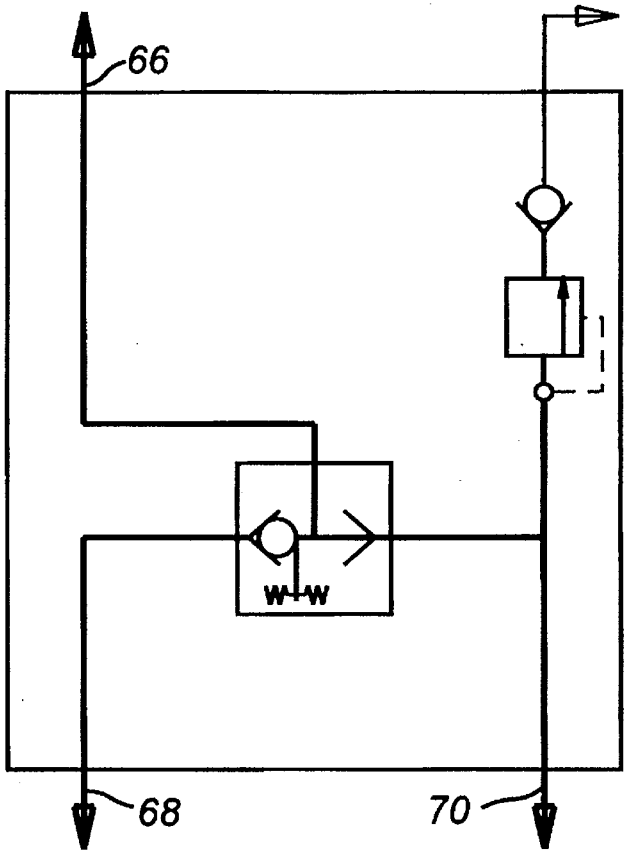
FIG. 9 is the hydraulic diagram of FIG. 8 showing the release of control pressure from the surface with the resulting realignment of the flowpaths, representing a condition with the SSV being in a closed position.
Figure 8:
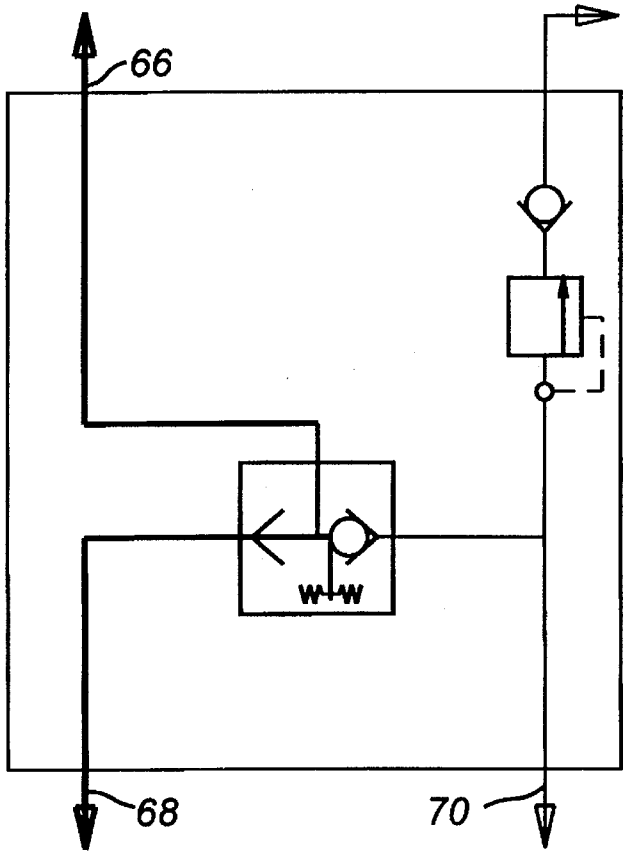
FIG. 8 is the hydraulic diagram of FIG. 7, with hydraulic pressure from the surface retained in the system to maintain the SSV in an open position.
Figure 11:
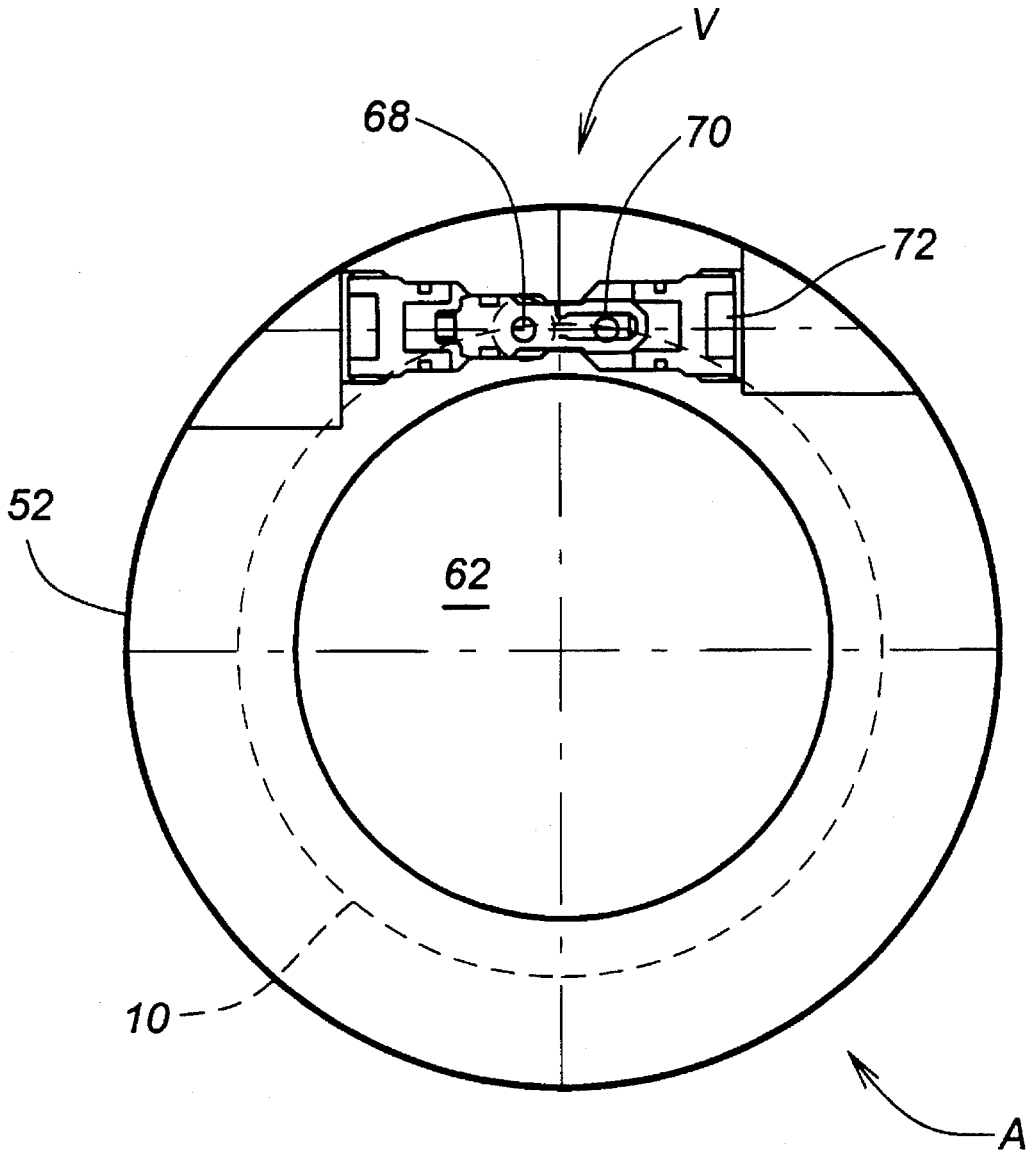
FIG. 11 is a view along line 11—11 of FIG. 2A.

The schematic hydraulic circuit diagrams shown in FIGS. 5–9 indicate the various configurations of shuttle valve V illustrated in FIGS. 3 and 4 during the process steps of initial position through opening of the SSV B and again to its closing. The initial position of the shuttle valve V is illustrated in FIG. 5. The connections are labeled with the same numerals as FIG. 3 for ease of understanding. In FIG. 6, hydrostatic pressure is initially applied from the surface through port 66 and is in flow communication with ports 68 and 70. In FIG. 7, the pressure has risen to a sufficient level to shift piston 74, aligning control pressure from the surface at port 66 to port 68 only. At the same time, outlet port 70 is placed in communication with port 72 leading to the annulus. FIG. 8 is similar to FIG. 7, with the pressure from the surface into inlet 66 continuing; however, the purging flow from port 70 out to the annulus has ceased. FIG. 9 shows a removal of pressure at port 66, which allows the higher pressure at port 68 to equalize into port 70. During the steps shown in FIG. 8, to hold sleeve 10 in the position where SSV B is in the open position, the operating pressure at port 68 exceeds that at port 70, with port 70 actually reflecting annulus pressure. When piston 74 once again moves to align ports 68 and 70, the pressure equalizes, allowing pistons 22 and 40 to shift in reaction to spring 60 bearing on tab 58, thereby moving sleeve 10 upwardly, finally allowing the SSV B to close.

It should be noted that although a spring in combination with a seal chamber, such as 116 and 114, respectively, is illustrated, other types of forces can be used to act initially on a piston such as 106. The physical execution of shuttle valve V can be accomplished in different ways than those illustrated and still accomplish the objective of the present invention of actuation of the control system to operate the SSV while, at the same time, automatically purging a predetermined volume from the control circuit to avoid abnormal wear on operating parts of the control system, such as seals 26, 28, 44, and 46.

The nature of the compressible fluid used in chambers 80 or 100, as well as the spring rate in the springs mounted therein, can be altered without departing from the spirit of the invention. Different fluids, initial pressures, or spring rates can be used depending upon the dimensional relationships of the piston involved and the expected forces on the piston from annulus pressure for the depth of the desired application for the embodiment illustrated in FIG. 3.

It is clear that the embodiment of FIG. 4 is not sensitive to actual or fluctuations of the annulus pressure since piston 106 is essentially in force balance from any pressure coming into it from outlet 118 in fluid communication with the annulus. One advantage to the shuttle valve V of the present invention is that, upon initiating the steps necessary to open the SSV B, the control fluid pressure is applied directly to pistons 22 and 40. Thereafter, to get movement of those pistons, the only incremental force necessary in the control line, such as 66, is a force sufficient to create the pressure imbalance on piston 74, which is, in essence, the pressure in chamber 80 and the spring force from spring 88. Similarly, in FIG. 4, incremental pressure in the control line through ports 96 and 98 is only needed to overcome the resistance to movement of piston 106 coming from the pressure applied from the compressible fluid in chamber 114 and the spring 116. Again, this minimal incremental force needed, which in the preferred embodiment can be in the order of 1000 to 3000 psi, facilitates the use of existing hydraulic systems that control surface safety components. By keeping the pressure requirements of the system at a low level, redundant high-pressure systems for the control of the SSV are not required.

In the preferred embodiment, the shuttle valve of FIG. 4 is preferably used in applications where there will be lower differential pressures between annulus pressure and the control pressures used in chamber 102. This is because it is desirable to keep the differential pressure low when a seal such as seal 108 or 104 moves across an opening in the body of shuttle valve V. The design of FIG. 3 can be used where there are higher differential pressures between the annulus pressure and the control pressures applied through port 66 since that design does not incorporate seals moving across open ports. It is within the purview of the invention to have alternative arrangements for the sealing off, which is illustrated in FIG. 3 as occurring between end 76 and seat 78. While a metal-to-metal seat is illustrated, other types of seating are within the purview of the invention, including the use of resilient materials for the seat or at the end 76 of piston 74.

Thus the improvement shown in FIG. 1, which illustrates the force balance on the actuation assembly by exposure of connector 34 to production tubing pressure in flowpath 62, acts to reduce the required pressures of the hydraulic control system which ultimately is used to move pistons 22 and 40. Additionally, by combining that system with the shuttle valve V, minimal incremental control pressures are required to initiate the opening sequence for the SSV B. As compared to prior designs where an internal sleeve spring had to resist the hydrostatic head in the control line from the surface, the present design is insensitive to the hydrostatic head from the control line. In prior designs, the greater depth meant higher control pressures were required to overcome a stiffer spring. A stiffer spring in a pilot valve was required to hold back the hydrostatic pressure in the control line, which increased with the depth of the application. By combining the force balance feature illustrated in FIG. 1, the spring 60 can have a significantly lower spring rate than in prior designs. The combination of that feature with the shuttle valve V further reduces the pressure requirements on the control system by, in effect, using the control pressure from the surface to act on both pistons 22 and 40 in a sequential manner to accomplish the opening and subsequent closing of the SSV B.

Figure 1B:
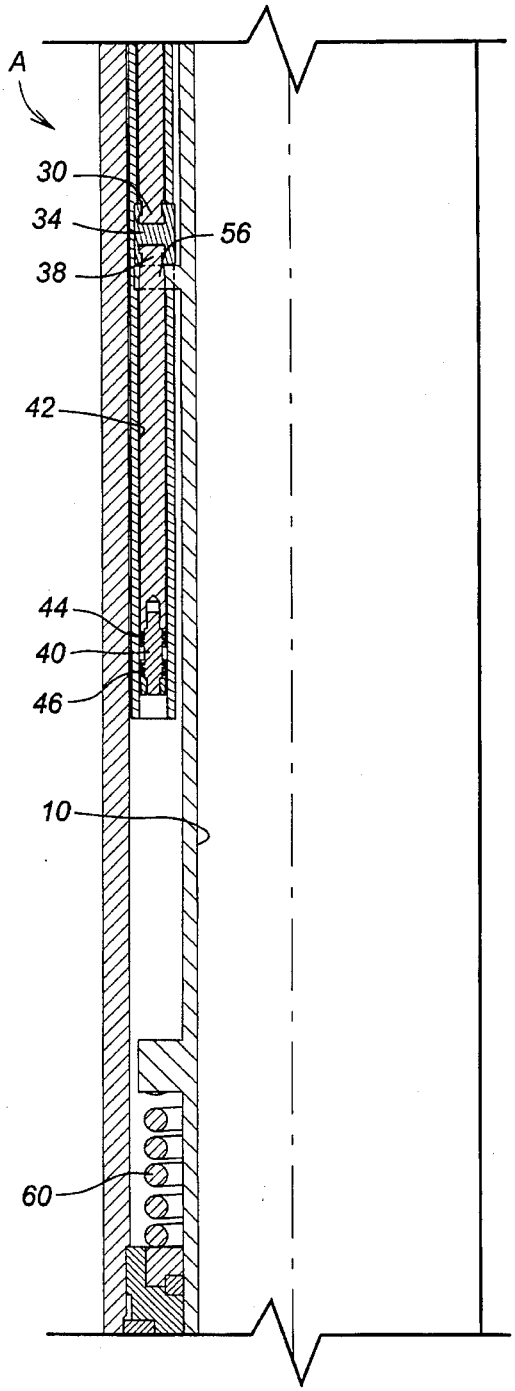
Figure 1C:
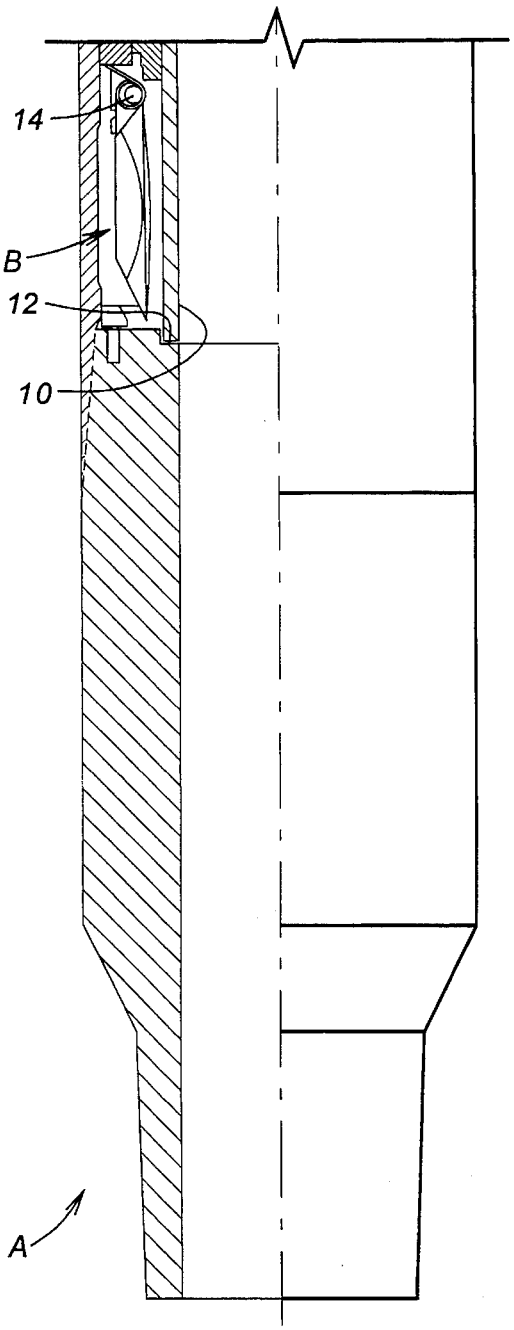
Figure 12:
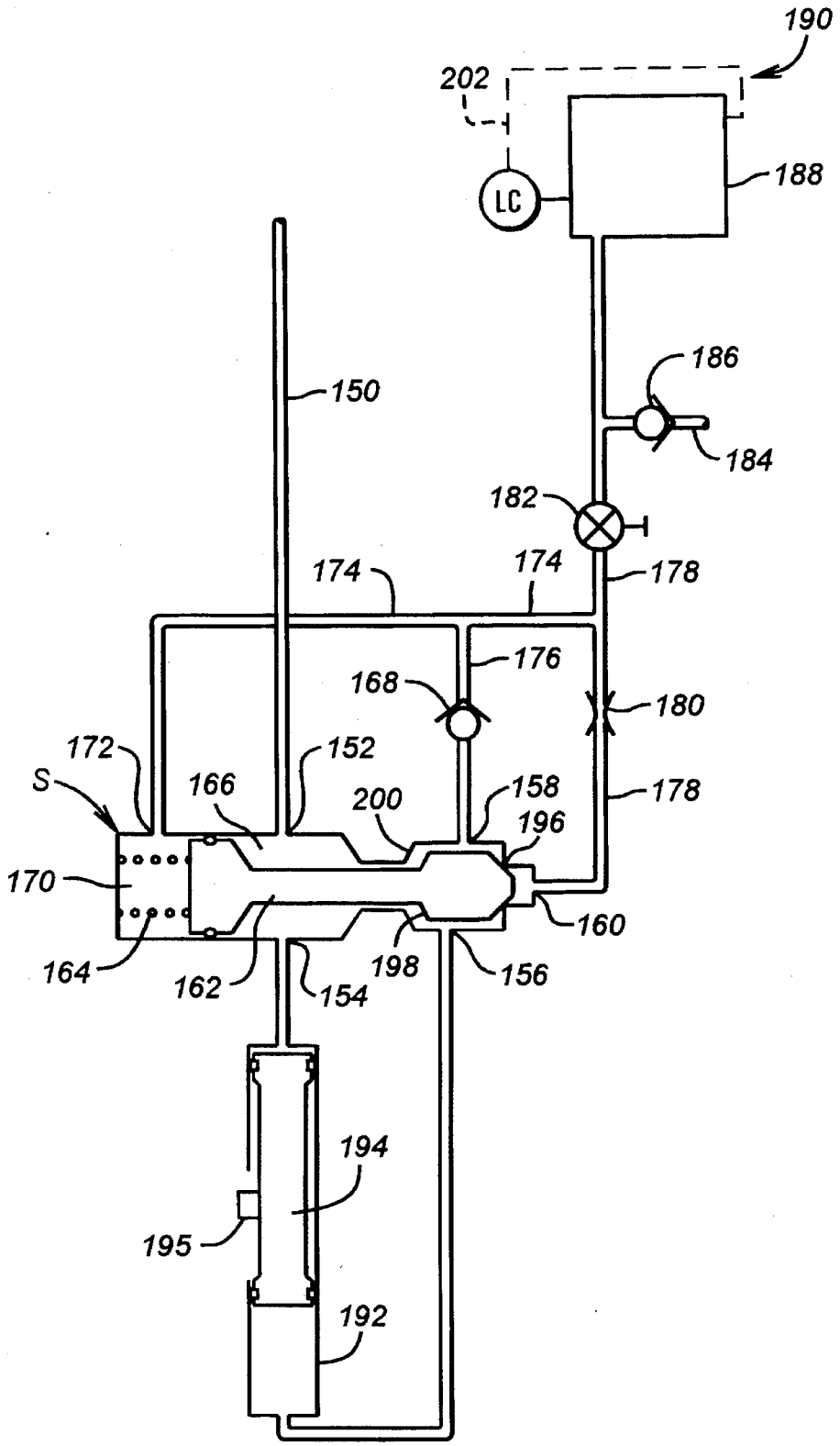
FIG. 12 is a schematic representation of the control system in use with a collection chamber.

In FIG. 12, the previously described control system is enhanced to allow for the recovery and reuse of control fluid when the control system is actuated. FIG. 12 schematically illustrates a single control line 150, which preferably comes from the surface to the shuttle valve assembly S. The control line pressure through line 150 enters a port 152 wherein in the position shown in FIG. 12 there is fluid communication to ports 154, 156 and 158, with port 160 blocked off by piston 162, which is biased by spring 164. Outward flow from chamber 166 through port 158 is blocked by check valve 168. Spring 164 is disposed in chamber 170 of shuttle valve S. Chamber 170 has an outlet 172 which is connected to line 174, which ultimately joins line 176 from check valve 168. Outlet 160 has a line 178 which is connected to it and ultimately is in fluid communication with line 174, which in turn has line 176 connected into it. Between outlet or port 160 and the connection from line 174, line 178 has a flow restrictor 180 disposed in it to create backpressure on port 160, as will be described below. After being joined by line 174, line 178 continues to an isolation valve 182, which operates normally open. Thereafter, line 178 has a branch for a fill port 184. Adjacent fill port 184 is a check valve 186 which prevents outward flow past the fill port 184, all on a branch line from line 178. The main line 178 continues into chamber 188. Chamber 188 has an inert gas pressure blanketing system schematically represented by arrow 190. The nitrogen blanketing system 190 selectively allows displaced fluid from port 160 to enter chamber 188 when it is necessary to open the subsurface safety valve, as illustrated in FIGS. 1A–C. Additionally, when the subsurface safety valve is allowed to go to a closed position by removal of or reduction of pressure in line 150, the built-up pressure in chamber 188 by the nitrogen system 190 allows accumulated fluid to be replaced into the hydraulic circuit through check valve 168. Those skilled in the art will appreciate that additional controls can be placed on chamber 188 to ensure against addition of gases into the hydraulic control circuit which could disadvantageously affect its operation. Such controls could be level sensors which trigger the nitrogen system 190 to easily admit additional fluid by regulating pressure in chamber or vessel 188 at a level lower than the predetermined pressure required to shift piston 162. When pressure is lowered in line 150, the nitrogen system 190 is automatically triggered to displace fluid accumulated in chamber 188 by maintaining a preset pressure by supplying gas to replace the displaced fluid until a low-level setting is achieved. Other ways to regulate the level in chamber 188 can be employed without departing from the spirit of the invention. Other blanketing or motive fluids other than nitrogen can be employed in the pressure system 190 without departing from the spirit of the invention. The details of the pressure- or level-regulation system which could selectively be employed are known control systems to those of skill in the art.

The function of the hydraulic system, as illustrated in FIG. 12, is similar to that previously described. Outlets 154 and 156 are, respectively, connected to an actuating cylinder 192, which has internally a piston 194, illustrated schematically. The schematic piston 194 is akin to the connected pistons 22 and 40, as illustrated in FIGS. 1A–C, and has a tab 195 to engage a sleeve (not shown) for reciprocal movement. Ultimately, when the schematic piston 194 shifts, it moves a sleeve such as sleeve 10, indicated in FIG. 1A, through the use of a tab 56, as shown in FIG. 1B. However, for clarity and simplicity in FIG. 12, the cylinder 192 and piston 194 are shown schematically without a representation of the final control element, i.e., a sleeve, such as sleeve 10 shown in FIGS. 1A–C.

Figure 10B:
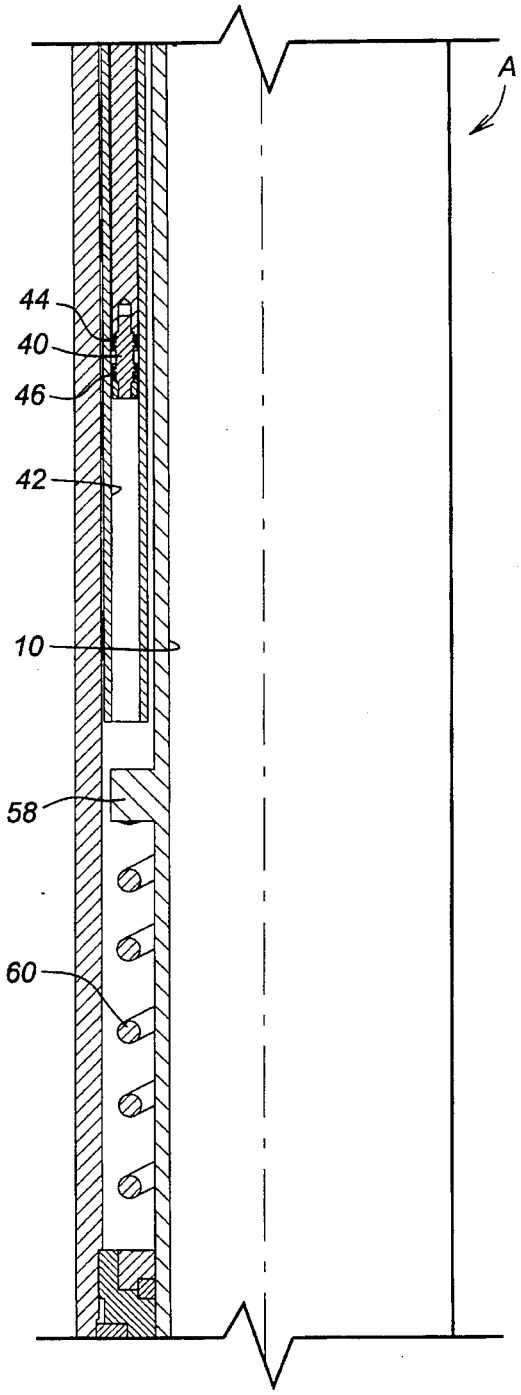
Figure 10C:
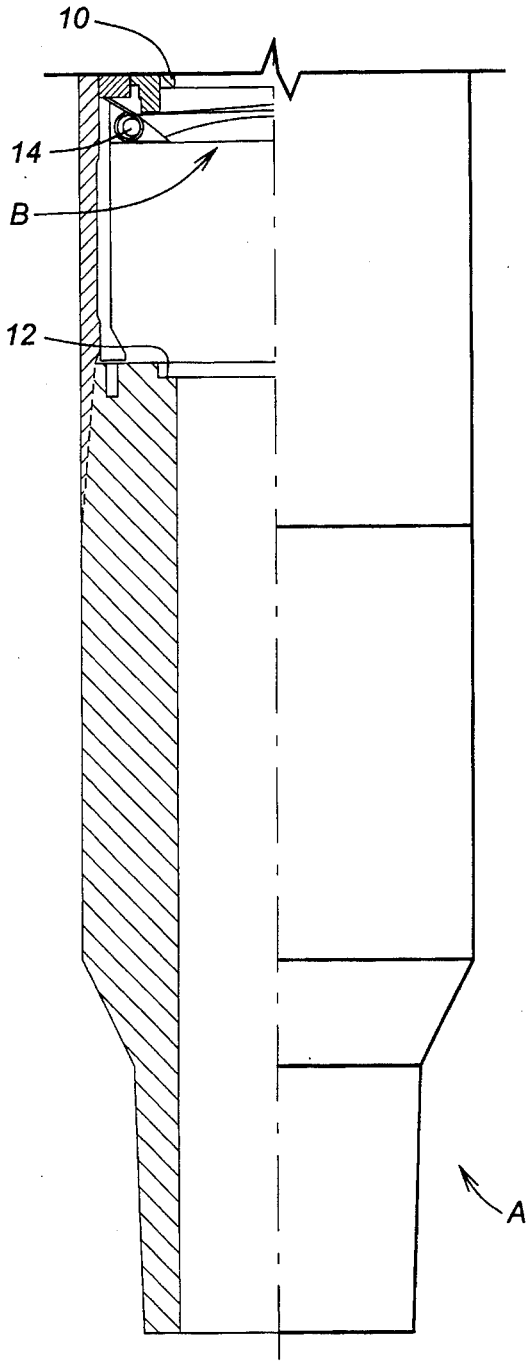

In the position shown in FIG. 12, a subsurface safety valve is in the closed position since a sleeve, such as sleeve 10 shown in FIG. 10A–C, is in the up position. In order to shift a sleeve such as sleeve 10 downwardly, pressure must be built up in control line 150 to displace the pressure equilibrium between outlets 154 and 156. As previously indicated, the cylinder 192 has a piston or pistons 194 therein, schematically illustrated in FIG. 12, which are in pressure balance, independent of the depth of submergence of the assembly illustrated in FIG. 12. In order to cause a pressure imbalance on piston 194, pressure is built up in control line 150. Since the piston 162 is biased against seat 196, port 160 is effectively closed. Port 158 is effectively closed because check valve 168 permits flow only into chamber 166 but not out of chamber 166 through port 158. As pressure begins to build in chamber 166, the force of spring 164 is overcome and the piston 162 lifts off the seat 196. At that point, flow begins through outlet 160 through restrictor 180 on the way ultimately to the chamber 188. The initial pressure in chamber 188 is lower than the operating pressure at that time in cavity 166; hence, the differential pressure across the restrictor 180 causes a flow therethrough. Because of the restriction in flow restrictor 180, a backpressure is created which limits the amount of flow into chamber 188 as the piston 162 is stroking against the force in the opposite direction provided by spring 164. Movement of the piston 162 in compressing spring 164 reduces the volume of cavity 170 and displaces fluid out of cavity 170 through port 172 and into line 174. As can be seen from FIG. 12, line 174 bypasses the flow restrictor 180. This means that the chamber 170 is connected to a lower-pressure zone at line 178 than is outlet 160, which must go through the flow restrictor 180 before reaching line 178 where line 174 ties into it. Ultimately, the piston 162 moves sufficiently to the left to compress spring 164 while such movement causes flow through restrictor 180. When movement of piston 162 results in contact of taper 198 with shoulder 200, there is a pressure differential between ports 154 and 156 . In effect, the restriction 180 serves to limit the volume of flow into chamber 188, as piston 194 is moved due to the differential pressure which is created between ports 154 and 156 as a result of the shifting of piston 162 until taper 198 bottoms on shoulder 200. The differential occurs because port 154 is pressurized, while port 156 only sees a lower pressure due first to the backpressure during flow through restrictor 180. Downstream of restrictor 180 in chamber 188, the control pressure maintained by the system 190 is always less than the pressure in line 150 required to move piston 162 against spring 164. This differential induces flow into chamber 188. Movement of piston 162 does result in some fluid displacement out of chamber 170 through port 172 and ultimately toward chamber 188 through line 174. When sufficient differential exists between ports 154 and 156, movement of piston 194 occurs and ultimately the final control element, i.e., a sleeve such as sleeve 10, is shifted downwardly to open the subsurface safety valve as previously described.

The fill port 184 is used for initial filling of the lines. A vent can be part of the control system 190 to release gas for pressure control or even to release hydraulic fluid in the event of a system 190 upset or malfunction. The isolation valve 182 is used if maintenance is required on the control circuits illustrated in FIG. 12.

In order to allow the subsurface safety valve to close as a result of an upward shifting of a sleeve such as 10, the pressure is merely reduced in the control line 150 until the force exerted by spring 164 overcomes the opposing hydraulic force and the piston 162 shifts to the right, bringing piston 162 back up against seat 196 and returning it to the position shown in FIG. 12. When the pressure in the control line 150 is reduced, taper 198 comes away from shoulder 200, which has the effect of pressure-equalization between ports 154 and 156, as previously described. With the reduction of applied pressure in the control line 150, the nitrogen pressurization system 190 acts to displace any accumulated fluid in chamber 188 back into the circuit through check valve 168 through a parallel line that bypasses restrictor 180.

The additional features illustrated in FIG. 12 allow for collection and recycling of the hydraulic control fluid as opposed to purging it as illustrated in the embodiment relating to FIGS. 1–10. This not only results in a costs savings to the operator in control fluid, but it also reduces the potential for pollution since stroking of piston 162 results in collection of any displaced fluid from the control circuit and an automatic return of any accumulated fluid back into the circuit. As previously described, a level controller, shown schematically as LC, can be connected pneumatically, hydraulically, or electrically to the nitrogen system 190, as indicated by dashed line 202, to use the applied pressure from the nitrogen blanketing system 190 to control the level in chamber 188. Upon rising level, the control system 190 can automatically vent gas in a manner well-known in the art.

The foregoing disclosure and description of the invention are illustrative and explanatory thereof, and various changes in the size, shape and materials, as well as in the details of the illustrated construction, may be made without departing from the spirit of the invention.

We claim:

1. A surface-actuated wellbore control system for a subsurface safety valve member in a flowpath of a tubing string, comprising:

a housing, having a bore therethrough aligned with the flowpath and containing the valve member therein;

a sleeve, having a predetermined weight, movably mounted to said housing for selective operation of the member;

at least one piston mounted to said housing, said piston selectively movable in at least one elongated opening;

a fluid pressure source for a control system fluid;

a single conduit extending from the surface and branching adjacent said opening for connecting, in fluid communication, said pressure source to at least two locations in said opening;

said piston dividing said opening into at least two discrete chambers, said piston having a pair of opposed faces, said conduit in flow communication with said piston faces to remove the effect of hydrostatic pressure in said single conduit from applying a force which would tend to move said piston;

control means in flow communication with said conduit for creating a differential pressure on said faces resulting in selective piston movement;

said control means comprising a shuttle valve which in a first position applies pressure from said pressure source to one of said chambers while allowing fluid pressure on another of said chambers to be reduced by passing through said shuttle valve;

a collection device for receiving said fluid passing through said shuttle valve;

said piston operably connected to said sleeve for selective tandem movement of said sleeve and piston in at least one direction for operation of the valve member.

2. The control system of claim 1, wherein:

said collection device returns accumulated fluid therein to said control means or said conduit upon lowering of pressure in said conduit, which creates the differential pressure between said collection device and said shuttle valve to induce flow.

3. The control system of claim 2, wherein:

said collection device further comprises a vessel with a pressure-control system connected to said vessel;

whereupon responsive to a pressure build-up by said source in said conduit, said shuttle valve moves to its first position and one of said chambers is aligned with said vessel, said pressure-control system allowing flow into said vessel from said chamber aligned with it by retaining a lower vessel pressure than the pressure in said chamber aligned with it.

4. The control system of claim 3, wherein:

said pressure-control system controls pressure in said vessel to a sufficient level to return accumulated fluid therein to said conduit or said control means when said shuttle valve moves to a second position in a direction in reverse of movement toward said first position as a result of a lowering of pressure in said conduit which results in pressure equalization on said piston.

5. The control system of claim 3, further comprising:

a restriction between said shuttle valve and said vessel to create backpressure in said shuttle valve as said valve is urged toward its said first position.

6. The control system of claim 5, further comprising:

a check valve in a parallel path to said restriction, said parallel path extending from adjacent said shuttle valve to said vessel and permitting flow from said vessel to adjacent said shuttle valve to selectively return accumulated fluid in said vessel to adjacent said shuttle valve.

7. The control system of claim 1, wherein:

said sleeve and said piston are configured in said housing to be in a force balance with respect to tubing string flowpath pressures applied to said sleeve and piston within said housing;

said conduit means comprises a single line from said pressure source at the surface of the wellbore to said control means adjacent said housing.

8. The control system of claim 7, further comprising:

a first and second piston in said opening, spaced from each other and operably linked to each other therebetween;

said pistons having an outer face exposed to one of said chambers and an inner face on the opposite end thereof, said inner faces of said pistons facing each other and operably connected to each other.

9. The control system of claim 8, wherein:

said operable connection between said facing faces is a link, said link exposed to applied pressures in said housing and connected to said piston faces in a manner as to place said pistons in pressure balance from applied fluid forces within the housing.

10. The control system of claim 9, further comprising:

biasing means in said housing acting on said sleeve for supporting just the weight of said sleeve in a first position away from said valve member;

said sleeve operably connected to said link for tandem movement in a direction toward a second position of said sleeve, wherein said biasing means is overcome and the valve member is opened.

11. A surface-actuated control system for a subsurface safety valve, comprising:

a housing;

a movable controlled element in said housing, said element responsive to fluid pressures applied in at least two places thereto, said controlled element operably connected to the subsurface safety valve;

a fluid pressure source;

a conduit extending from said source;

a valve in fluid communication through said conduit with said pressure source at an inlet thereon;

said valve having a plurality of outlets, comprising a first outlet and a second outlet in fluid communication, respectively, with said controlled element in a manner so as to isolate said controlled element from movement due to the hydrostatic pressure in said conduit;

a single piston in said valve selectively movable between a first and second position;

said valve further comprising a vent port;

said piston movable in response to a predetermined pressure at said inlet to said valve to shift from said first position, where said inlet is aligned with said first and second outlets, to said second position, where one of said outlets is realigned to said vent port for simultaneous actuation of said controlled element, and purging a predetermined amount of pressurized fluid;

a collection system to collect said purged fluid and to selectively return it to said valve or said conduit extending to said valve by differential pressure.

12. The control system of claim 11, wherein:

said vent port is piped through a first pipe connection to a vessel which comprises a part of said collection system;

a pressure-regulation system on said vessel to maintain its pressure at a pressure lower than said predetermined pressure required to move said piston;

whereupon when said piston causes one of said outlets to be aligned to said vessel, fluid flows into said vessel.

13. The control system of claim 12, wherein:

said vessel is connected to said valve or said conduit extending to said valve by a second piped connection which runs parallel to said piped connection to said vent port;

whereupon a lowering of pressure in said valve which closes said vent port fluid can return from said vessel to said valve through said second pipe connection by pressure differential.

14. The control system of claim 13, further comprising:

a check valve in said second piped connection to only allow flow out of said vessel;

a flow restrictor in said first piped connection to minimize vented fluid into said vessel as said piston moves from its said first to its said second positions.

15. The control system of claim 11, further comprising:

biasing means in said valve for biasing said piston toward its said first position;

said piston having a first surface on which said biasing means operates and a second surface;

said vent port formed having a first seat circumscribing it on said valve, said second surface on said piston conforming in shape to said seat for sealing off said vent port when said piston is in said first position.

16. The control system of claim 15, wherein:

said first surface divides a chamber in said valve into a first and second variable volume cavity, said cavities sealingly isolated from each other;

said biasing means disposed in said first cavity and said first seat disposed in said second cavity;

said inlet and outlets on said valve in flow communication through said second cavity when said piston is in said first position.

17. The control system of claim 16, further comprising:

a second seat in said second cavity located between said outlets;

whereupon when said pressure source increases inlet pressure to overcome said biasing means, said piston sealingly contacts said second seat, opening said vent port and isolating one of said outlet ports from said second cavity while aligning said isolated outlet with said vent port.

18. The control system of claim 17, wherein:

said biasing means comprises a spring in combination with a compressible fluid;

said second surface on said piston is exposed at least in part to annulus pressure when said piston is in said first position, to counteract opposing forces from said spring and compressible fluid in said first chamber;

whereupon pressures at said source of under 3000 psi actuate said piston from said first to said second position, thereby actuating movement of said controlled element for ultimate operation of a subsurface safety valve located at any depth with any tubing pressure.

19. The control system of claim 11, wherein:

said piston is mounted in a cavity in said valve, dividing said cavity into a plurality of chambers;

said cavity comprises a first chamber sealingly isolated from a second chamber by a first seal;

said inlet in flow communication with both said first and second chambers;

said outlets in communication with said second chamber when said piston is in said first position;

said piston having differing surface areas exposed to said first and second chambers such that pressure applied at said inlet causes an unbalanced force toward said second position of said piston.

20. The control system of claim 19, wherein:

one of said outlets becomes aligned with said first chamber upon sufficient movement of said piston while another of said outlets becomes aligned with said vent port.

21. The control system of claim 20, wherein:

said piston movement toward said second position moves said first seal over one of said outlets, transferring it from alignment with said second chamber to alignment with said first chamber;

said piston comprises a second seal which isolates said vent port from said second chamber when said piston is in said first position, said second seal moves past said vent port, opening said second chamber to said vent port as said piston reaches said second position.

22. The control system of claim 11, wherein:

said controlled element is in force balance with fluid forces within a bore defined by said housing;

said outlets of said valve are in flow communication with said controlled element through spaced inlets on said housing such that said controlled element is in force balance within said housing until said valve directs differential pressure to said spaced inlets on said housing.

23. The control system of claim 22, further comprising:

a sleeve having a predetermined weight and mounted within said housing and in force balance with fluid forces within a bore in said housing, said sleeve operably connected to said controlled element, said sleeve movable between a first and second position;

said housing further comprises a spring to support just the weight of said sleeve in its said first position when the subsurface safety valve is closed;

said controlled element shifting said sleeve to its said second position to open the subsurface safety valve by overcoming the force of said spring in said housing.

24. A method of operating a subsurface safety valve, comprising:

running a single control line from a surface-mounted fluid pressure source;

mounting a shifting sleeve having a predetermined weight and in a subsurface safety valve housing;

orienting said shifting sleeve to be in force balance from fluids within the flow bore through said housing;

mounting a fluid-operated actuating mechanism in said housing;

connecting said mechanism to said sleeve for tandem movement in at least one direction;

using a pilot valve to connect said single line to said two places on said mechanism;

supplying a pressurized fluid to at least two places on said mechanism;

configuring the mechanism to be in hydrostatic force balance until said two points are supplied with a predetermined differential pressure;

supporting the weight of said shifting sleeve in said housing in a first position;

applying a predetermined differential pressure to said two points to create an unbalanced force on said mechanism;

overcoming the supporting force with said unbalanced force;

shifting said sleeve to open the subsurface safety valve said supplying step comprises:

venting out a volume of pressurized fluid when said pilot valve actuates in response to applied pressure beyond a predetermined value; and creating said predetermined differential pressure on said mechanism by said venting;

collecting said vented volume in a vessel;

selectively returning said vented volume to said pilot valve or said single line connected to said pilot valve by pressure differential.

25. The control system of claim 24, further comprising:

controlling the pressure in the vessel at a pressure lower than said predetermined pressure which creates said unbalanced force on said mechanism;

allowing flow through said pilot valve to said vessel from one of said two points on said mechanism in order to create said unbalanced force.

26. The control system of claim 25, further comprising:

regulating flow through a first line into said vessel from said pilot valve;

limiting the volume of fluid displaced into said vessel while said pilot valve shifts to create said unbalanced force.

27. The control system of claim 26, further comprising:

providing a second line parallel to said first line with a check valve to allow one-way flow from said vessel to said pilot valve or said single control line running to it;

returning fluid from said vessel through said check valve when the pressure in said control line is reduced to below vessel pressure.

28. The method of claim 24, further comprising the steps of:

orienting said single line to at least one inlet on said pilot valve;

providing initial flow communication through said pilot valve to both said places on said mechanism through outlets on said pilot valve, when a piston in said pilot valve is in a first position;

said overcoming step further comprises:

moving said piston in said pilot valve to a second position;

aligning one of said outlets to a vent port in flow communication with the annulus by said piston movement;

creating an unbalanced force on said mechanism with said venting.

29. The method of claim 28, further comprising the steps of:

providing bias to said piston to keep it in its said first position against hydrostatic force in said single line connected to said inlet;

applying a minimal incremental pressure to said inlet from said pressure source to overcome the unbalanced force applied to said piston from said bias acting on said piston to move it toward its second position;

creating an unbalanced force on said mechanism from said pressure source, acting through one of said outlets of said valve, which is slightly higher than said supporting force on said sleeve, to allow said mechanism to move said sleeve to open the subsurface safety valve.

30. A method for controlling a well subsurface safety valve in a housing having a flow bore therethrough, comprising:

using a source of fluid pressure in the range of 100–3000 psi;

running a single control line from said fluid pressure source to two points on an operating mechanism for a movable sleeve having a predetermined weight on the housing of the subsurface safety valve;

isolating said operating mechanism from hydrostatic forces from said control line;

configuring said movable sleeve in the flow bore of said housing to be in force balance from fluid pressure therein;

operating said sleeve with said source of fluid pressure at any well depth or any tubing pressure;

venting a portion of said fluid under pressure from said operating mechanism as a result of said operating step;

collecting the fluid from said venting step in a vessel;

returning the collected fluid to said operating mechanism or control line connected thereto by pressure differential.

31. The method of claim 30, further comprising the steps of:

supporting just the weight of said sleeve with a force applied by a spring;

applying a force on said sleeve through said mechanism that slightly exceeds the force applied by said spring to initiate sleeve movement to open the subsurface safety valve.

32. The method of claim 31, further comprising the steps of:

using a pilot valve to create an unbalanced force on said mechanism by selective alignment of control pressure from said single line to one of said places on the mechanism while aligning another place on the mechanism with a vent in fluid communication with said vessel through a restriction;

providing a return line with a check valve from said vessel to allow one-way flow out of said vessel while bypassing said restriction and into said pilot valve or control line connected thereto.

33. The method of claim 32, further comprising the steps of:

using a shifting piston in a pilot valve housing to accomplish said creation of an unbalanced force;

providing bias on said piston to stay in a position where no unbalanced force on said mechanism is created;

configuring said bias on said piston to slightly exceed anticipated control line hydrostatic force for a predetermined depth of installation;

providing an incremental force from said source of fluid pressure to overcome the force of said bias less said hydrostatic control line force to shift said piston against said bias for creating said unbalanced force on said mechanism.

34. A control system for a subsurface safety valve, comprising:

a housing;

a movable controlled element in said housing, said element responsive to fluid pressures applied in at least two places thereto, said controlled element operably connected to the subsurface safety valve;

a fluid pressure source;

a valve in fluid communication with said pressure source at an inlet thereon;

said valve having a plurality of outlets, comprising a first outlet and a second outlet in fluid communication, respectively, with said controlled element in a manner where a pressure differential at said outlets applied from said pressure source causes movement of said controlled element;

a piston in said valve selectively movable between a first and second position;

said valve further comprising a vent port;

said piston movable in response to a predetermined pressure at said inlet to said valve to shift from said first position, where said inlet is aligned with said first and second outlets, to said second position, where one of said outlets is realigned to said vent port for simultaneous actuation of said controlled element, and purging a predetermined amount of pressurized fluid;

a collection system to collect said purged fluid and to selectively return it to said valve or said conduit extending to said valve by differential pressure;

said piston is mounted in a cavity in said valve, dividing said cavity into a plurality of chambers;

said cavity comprises a first chamber sealingly isolated from a second chamber by a first seal;

said inlet in flow communication with both said first and second chambers;

said outlets in communication with said second chamber when said piston is in said first position;

said piston having differing surface areas exposed to said first and second chambers such that pressure applied at said inlet causes an unbalanced force toward said second position of said piston;

wherein one of said outlets becomes aligned with said first chamber upon sufficient movement of said piston while another of said outlets becomes aligned with said vent port;

said piston movement toward said second position moves said first seal over one of said outlets, transferring it from alignment with said second chamber to alignment with said first chamber;

said piston comprises a second seal which isolates said vent port from said second chamber when said piston is in said first position, said second seal moves past said vent port, opening said second chamber to said vent port as said piston reaches said second position;

said cavity comprises a third chamber;

biasing means in said third chamber for biasing said piston toward said first position, said biasing means defeated by a pressure at said inlet from said pressure source of less than 3000 psi, moving said piston to its second position and actuating said controlled element for operation of the subsurface safety valve when said housing is mounted at any depth with any tubing pressure.

* * * * *